United States Patent [19]

Maynard

[11] 4,044,670

[45] * Aug. 30, 1977

[54] STENCIL DUPLICATOR

[75] Inventor: Michael Maynard, London, England

[73] Assignee: Gestetner Limited, London, England

[ * ] Notice: The portion of the term of this patent subsequent to Mar. 16, 1993, has been disclaimed.

[21] Appl. No.: 636,821

[22] Filed: Dec. 2, 1975

Related U.S. Application Data

[63] Continuation-in-part of Ser. No. 397,305, Sept. 14, 1973, Pat. No. 3,943,850.

[51] Int. Cl.[2] ..... B41F 15/12

[52] U.S. Cl. ..... 101/128.1; 242/75.5

[58] Field of Search ..... 101/116, 122, 127, 127.1, 101/132, 130, 132.5, 415.1; 53/118; 242/67.3 R, 201, 75.5

[56] References Cited

U.S. PATENT DOCUMENTS

| | | | |
|---|---|---|---|
| 1,017,984 | 2/1912 | Martin | 242/67.3 R |
| 1,958,068 | 5/1934 | Raiche | 53/118 X |
| 2,424,739 | 7/1947 | Canady | 242/75.5 |
| 2,498,609 | 2/1950 | Reil | 242/75.5 X |
| 3,491,684 | 1/1970 | Borinsky | 101/132 |
| 3,554,465 | 1/1971 | Marukawa | 242/201 |
| 3,570,397 | 3/1971 | Styles | 101/122 X |
| 3,727,856 | 4/1973 | Kitch | 242/75.5 |
| 3,788,221 | 1/1974 | Borneman | 101/132 X |

*Primary Examiner*—Ernest T. Wright, Jr.
*Assistant Examiner*—R. E. Suter
*Attorney, Agent, or Firm*—Fleit & Jacobson

[57] ABSTRACT

A device for rolling up onto a core a stencil or ink screen being removed from a duplicator, in which means alongside the or a duplicator cylinder for supporting a core and for driving it at a peripheral speed in excess of the peripheral speed of the duplicator so that a stencil or ink screen from the duplicator may be unrolled from the cylinder and onto the core with tension in the stencil or ink screen maintained by virtue of slipping drive to the core.

6 Claims, 2 Drawing Figures

STENCIL DUPLICATOR

RELATED APPLICATIONS

This application is a continuation-in-part of my application Ser. No. 397,305 filed Sept. 14, 1973 now U.S. Pat. No. 3,943,850.

FIELD OF THE INVENTION

The present invention relates to stencil duplicators and more particularly to assisting in removing stencils or ink screens from such machines. Stencils and ink sceens are at present removed entirely by hand and it is an object of this invention to provide mechanical means for assisting the removal.

PRIOR ART

In U.S. Pat. No. 3,788,221 (Borneman) there is disclosed a fully automated printing machine which forms thermographically an image on a stencil corresponding to an image on an original, carries the stencil for repetitive printing operations, and automatically rejects the used stencils by feeding them between successive convolutions of a spiral build-up of blotting web on a take-up roll. When full, this blotting web roll is disposed of, thereby avoiding the need for the duplicator operator to handle the inked stencils after use. With this arrangement, there is need for a bulky reception means to hold both the take-up roll for blotting web and also the supply roll of the same blotting web. More importantly, such apparatus makes no provision for re-use of any of the stencils. Any stencil fed into this spiral of blotting web must be regarded as disposed of, and thus if, at some later date, it is desired to produce further copies with the same image, a fresh stencil would need to be cut.

With the increasing cost of printing materials, it is desirable to avoid disposing of a stencil until it is no longer of further use and accordingly one object of the present invention is to provide a stencil duplicator in which a stencil can readily be received and retained individually on a support member for subsequent disposal or transfer to storage.

A second object of the present invention is to provide a stencil duplicator including means for receiving and retaining one used ink screen either for disposal purposes or for storage during use with an alternative ink screen, for example when a different colour of ink is in use.

SUMMARY OF THE INVENTION

According to this invention we provide a stencil duplicator including at least one duplicator cylinder; means carried by said at least one duplicator cylinder for holding a stencil for rotation with said cylinder; a core for receiving one end of said stencil during removal of the stencil from said duplicator; duplicator cylinder drive means operatively connected to said at least one duplicator cylinder; torque limiting core holding and driving means adapted to removably support said core adjacent and parallel to said at least one cylinder and to be driven by said duplicator cylinder drive means, said core holding and driving means being constructed to rotate said core with a surface speed higher than that of said at least one duplicator cylinder but with a limiting maximum torque transmitted to said core; and means for optionally engaging drive from said duplicator cylinder to said core driving means.

DESCRIPTION OF THE PREFERRED EMBODIMENTS

Figure 1:
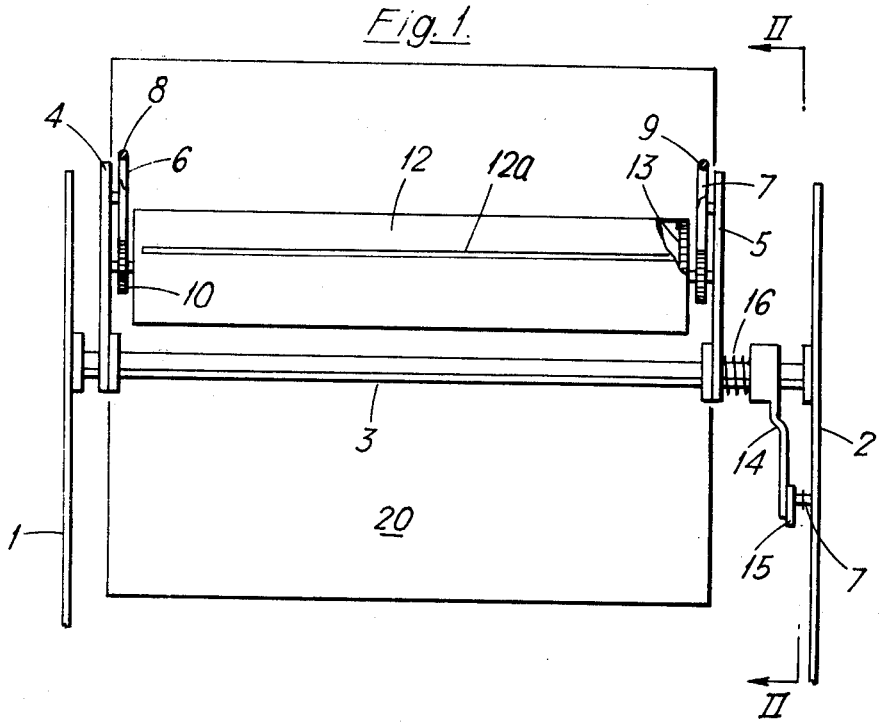
Figure 2:
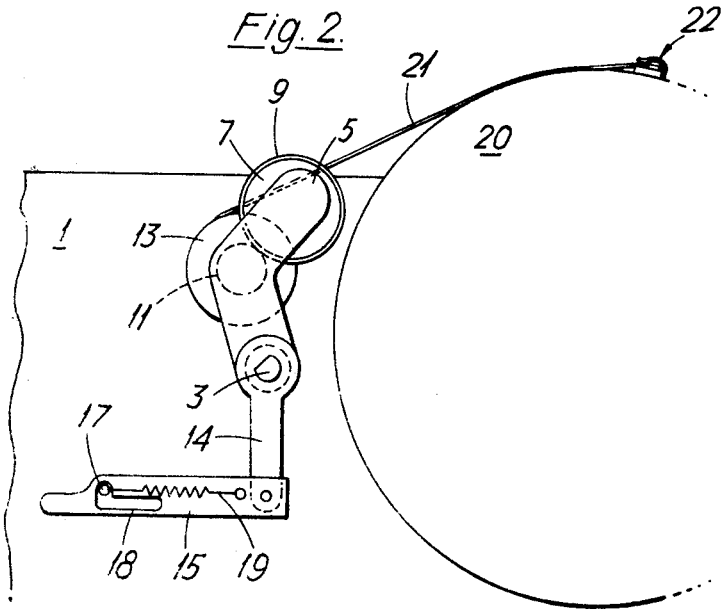

In order that the invention may be more clearly understood, the following description is given, merely by way of example, with reference to the accompanying drawings, in which:

FIG. 1 is an elevation of one form of stencil duplicator according to the invention; and FIG. 2 is a view of the line II—II of FIG. 1.

FIGS. 1 and 2 show the left and right hand side frames 1, 2 of a twin cylinder duplicating machine and the upper duplicator cylinder 20 extending therebetween. A bar 3, having a D-section, is rotatably carried by and extends between the two side frames.

A cranked lever 4 is fixed to the bar 3 near the left hand side frame 1, while a second cranked lever 5 is slidable on, but rotatable with, the bar 3 near the right hand side frame 2.

At the outer end of each cranked lever 4, 5 is rotatably mounted a drive wheel 6, 7. These drive wheels are of plastics material and have peripheral grooves in which are located O-rings 8, 9 serving as tyres to engage the cylinder 20.

The drive wheels 6, 7 are in surface contact with knurled, plastics, secondary drive wheels 10, 11, respectively, freely rotatably mounted on the levers 4, 5. Coaxial with, and fixed to rotate with, the secondary drive wheels are core holding members in the form of knurled discs 13 on which is mounted a core roller in the form of a hollow cylinder 12. The core roller 12 is provided with a slot **12*a* for a purpose to be described below. Each secondary drive wheel 10 or 11 and its associated disc 13 may be integral. The core roller 12 obscures the left hand disc, but is shown cut away in part at its right end to show part of one of the two discs 13**.

A control means for the apparatus is capable of pivoting the two levers simultaneously and includes a two-lever articulation linkage 14, 15, of which a first lever 14 is fast with the D-shaped bar 3 between the right hand lever 5 and side frame 2 for rotation with the lever 5. Between lever 5 and lever 14 is a compression spring 16 on the bar 3 urging lever 5 to the left as shown to hold the right hand core-supporting knurled disc 13 in engagement with the core roller 12.

The control means shown clearly in FIG. 2 comprises, in addition to the pivoted levers 14, 15 of the articulation linkage, a pin 17 fixed to the side frame 2 and engaging in an L slot 18 in the lever 15. A tension spring 19 connects pin 17 to lever 15, urging lever 15 to the left. Leftward movement of lever 15 would cause clockwise rotation of lever 14 and thus bar 3, bringing drive rollers 6, 7 into contact with the machine cylinder, shown at 20 in FIG. 2. Lever 15 can be retained in its position as shown in FIG. 2, however, by the pin 17 engaging in the recess formed by the shorter limb of the L slot at the left end of the slot.

In order to achieve the desired "over drive" to the core roller 12, the secondary wheel 10, 11 is smaller than the drive wheel 6, 7 and the drive wheel 6, 7 is about the same diameter as the core roller 12 so that the surface speed of the core roller 12 will be greater than the cylinder surface speed to ensure tension in the stencil or screen during removal from the cylinder, thereby providing a clean and neat removal and rolling up. A suitable ratio of core roller to cylinder surface speeds is $1^1/3:1$, i.e. approximately $33^1/3\%$ over drive to the core roller 12 in terms of union stencil speed.

When a stencil 21 spans the gap between the cylinder 20 and core roller 12 the tension maintained by the over drive will induce slippage in the drive to the core, e.g. between the cylinder 20 and the drive wheel tyres 8, 9 and it is for this reason that the material for the tyres 8, 9 of drive wheels 6, 7 will transmit a maximum frictional force to the wheels 6,7 which limits the torque applied to the core 12 to avoid rupture of the stencil 21.

The apparatus may be operated as follows to remove a stencil or the ink screen from the duplicator. Before, for example, a stencil is to be removed from the cylinder 20, a core roller 12 is placed on and between the discs by moving lever 5, carrying the drive wheels 7 and 11 and the knurled disc 13, to the right to allow positioning of the core roller 12 and releasing it again to allow the knurled disc 13 to engage the right hand end of the core roller 12. As explained above, compression spring 16 causes the core roller 12 to be firmly held.

When the stencil 21 is ready for removal, the lever 15 of the control mechanism is then simply raised relative to the pin 17 fixed to side frame 2, whereon tension spring 19 can rotate bar 3 until drive wheels 6, 7 contact cylinder 20 on either side of a stencil thereon.

The free end of the stencil is lifted manually from the cylinder, placed on the top of the core roller 12 and pressed thereagainst. The ink and moisture present will provide sufficient adherence.

Appropriate rotation in this case in the anti-clockwise sense, of the cylinder 20 will then cause the stencil to be rolled up on core roller 12, and thus removed from the cylinder. When the stencil is completely rolled up on the core roller 12 the drive wheels 6, 7 are withdrawn from the surface of cylinder 20 simply by pushing the link 15 forwardly (to the right as viewed in FIG. 2), until pin 17 engages in the recess in slot 18 to hold the link 15 with the spring 19 in tension.

At some later convenient time, for example during printing with a fresh stencil while the duplicator is automatically counting the number of copies required, the operator can at his or her leisure remove the core roller 12 simply by sliding lever 5 on bar 3 (see FIG. 1).

It is also possible for stencils themselves to form the required roller, rather than requiring a separate core roller. This can be achieved by adapting the stencil backing sheet, which is normally attached to a stencil but removed therefrom once the stencil has been placed on the duplicating machine, such that after removal from the stencil heading card the backing sheet can be rolled up to provide the roller to be fitted on the roller engaging members 13.

The embodiment particularly described above could also be used for rolling up ink screens, particularly using the slot 12*a,* or other attachment means (not shown), to accommodate the heading bar and springs. The apparatus could also, if it were positioned on the other side of the cylinder, i.e. the right hand side in FIG. 2, remove a stencil with the head leading, again, particularly if the slot 12*a* is provided to receive the head strip on the stencil.

Where the cores are of tubular form, the core engaging members could be collets, i.e. frusto-conical members instead of the discs 13 shown, and the core may if desired by mounted thereon so as to slip rotatably relative thereto.

The core may take any other practical form, for instance it could be a flat card but where, as in the above described construction it is in the form of a roller, it may be made of thin cardboard or plastics material. The core is expected to be extremely simple and cheap to make, so that a used stencil which is no longer required may be discarded with its supporting core within it, or a stencil or ink screen can be stored for a time wrapped on the core.

Similar considerations apply to removing ink screens, for instance for temporary storage while ink of a different colour and therefore a different screen is used. Again, the screen can be removed with either end leading into the slot 12*a* to accommodate the springs and header bar normally provided at the free end of the screen. The springs could, alternatively, be clipped to the core or whatever other means are provided for rolling the screen up.

I claim:

1. A stencil duplicator including at least one duplicator cylinder; means carried by said at least one duplicator cylinder for holding a stencil for rotation with said cylinder; a core for receiving one end of said stencil during removal of the stencil from said duplicator; means operatively connected to said at least one duplicator cylinder for driving said cylinder for rotation in use of the duplicator; torque limiting core holding means constructed to removably support said core for rotation adjacent and parallel to said at least one cylinder; core driving means optionally engageable with said duplicator for transmitting limited torque drive from said cylinder drive means to said core holding means, said core driving means being effective to rotate said core with a surface speed higher than that of said at least one duplicator cylinder but with a limiting maximum torque transmitted to said core; and means for optionally engaging drive from said duplicator cylinder to said core driving means.

2. A stencil duplicator according to claim 1, wherein said core holding means include rotatable means for frictionally engaging and supporting said core, whereby the frictional engagement between said rotatable core engaging and supporting means and the core supported thereby limits the torque transmitted to said core.

3. A duplicator according to claim 1, wherein said driven rotatable core support means includes a pair of coaxial, axially spaced rotatable members each constructed to support a respective end of said core, and resilient means biasing at least one of said rotatable members towards the other.

4. A duplicator according to claim 1, wherein said core is a cylindrical tube having a rectilinear slot extending from a point close to one end of said tube and up to the other end of said tube.

5. A duplicator according to claim 1, wherein said means for optionally engaging drive to said core driving means comprise at least one friction wheel, means mounting said friction wheel for optional rolling driving engagement with said at least one duplicator cylinder, and means drivingly connecting said at least one friction wheel to said core.

6. A duplicator according to claim 5, wherein said at least one wheel has a peripheral tyre to engage said cylinder with a maximum frictional grip to limit the transmitted torque to avoid rupture of a stencil attached to said stencil holding means and said core.

* * * * *